US011217954B2

(12) United States Patent
Duermeier et al.

(10) Patent No.: US 11,217,954 B2
(45) Date of Patent: Jan. 4, 2022

(54) METHOD AND DEVICE FOR PRODUCING A CABLE CONNECTION ASSEMBLY

(71) Applicant: MD ELEKTRONIK GmbH, Waldkraiburg (DE)

(72) Inventors: Christian Duermeier, Neumarkt St. Veit (DE); Walter Lang, Waldkraiburg (DE); Hubert Huber, Kirchdorf (DE); Rudolf Wiebe, Kraiburg am Inn (DE)

(73) Assignee: MD ELEKTRONIK GmbH, Waldkraiburg (DE)

( * ) Notice: Subject to any disclaimer, the term of this patent is extended or adjusted under 35 U.S.C. 154(b) by 0 days.

(21) Appl. No.: 17/114,513

(22) Filed: Dec. 8, 2020

(65) Prior Publication Data

US 2021/0194197 A1 Jun. 24, 2021

(30) Foreign Application Priority Data

Dec. 18, 2019 (EP) ..... 19 217 572

(51) Int. Cl.

| | |
|---|---|
| ***H01R 43/04*** | (2006.01) |
| ***H01R 43/048*** | (2006.01) |
| ***H01R 43/058*** | (2006.01) |
| *H01R 4/20* | (2006.01) |

(52) U.S. Cl.

CPC ..... *H01R 43/048* (2013.01); *H01R 43/058* (2013.01); *H01R 4/20* (2013.01)

(58) Field of Classification Search

CPC ..... H01R 43/048; H01R 43/058; H01R 4/20; H01R 9/0518; H01R 43/0585; Y10T 29/49183; Y10T 29/49185; Y10T 29/53209

USPC ..... 29/517, 753, 863, 866

See application file for complete search history.

(56) References Cited

U.S. PATENT DOCUMENTS

| | | | | |
|---|---|---|---|---|
| 1,493,515 | A * | 5/1924 | He | H01R 43/0424 29/517 |
| 2,567,155 | A * | 9/1951 | Macy | H01R 43/058 29/866 |
| 3,499,101 | A | 3/1970 | Forney, Jr. et al. | |
| 3,728,889 | A * | 4/1973 | McIver | H01R 4/20 29/753 |
| 9,496,671 | B2 * | 11/2016 | Dierks | B25B 7/06 |
| 10,355,379 | B1 | 7/2019 | Lewis et al. | |

* cited by examiner

*Primary Examiner* — Donghai D Nguyen

(74) *Attorney, Agent, or Firm* — Leydig, Voit & Mayer, Ltd.

(57) ABSTRACT

A method provides for producing a cable connection assembly including an electrical cable connected to a cable connector. The cable connector is positioned on a conductor end portion, so that a portion of the insulating layer is at least partially surrounded by the cable connector. The conductor end portion is disposed within a fastening tube, so that a first tube portion of the fastening tube surrounds the cable connector, and a second tube portion of the fastening tube surrounds the cable jacket. The fastening tube is pressed between strip-shaped pressing surfaces which are disposed around a central axis at a constant distance therefrom. During the pressing step, the first tube portion is pressed to a first inner diameter and the second tube portion is pressed to a second inner diameter greater than the first inner diameter.

20 Claims, 5 Drawing Sheets

METHOD AND DEVICE FOR PRODUCING A CABLE CONNECTION ASSEMBLY

CROSS-REFERENCE TO PRIOR APPLICATION

Priority is claimed to European Patent Application No. 19 217 572.7, filed on Dec. 18, 2019, the entire disclosure of which is hereby incorporated by reference herein.

FIELD

The invention relates to a method for producing a cable connection assembly including a cable connector and an electrical cable connected to the cable connector. The invention also relates to a device for producing such a cable connection assembly.

BACKGROUND

Today, due to the increasing digitization of components and systems and the associated increasing amount of data to be transmitted, increasingly higher demands are being placed on the electrical cables required for transmission. In particular, a constantly high signal transmission quality over large frequency ranges combined with low, or at least constant attenuation over the respective frequency range plays an increasingly central role.

In order to meet these requirements, use is made of coaxial cables, for example. The coaxial arrangement of the inner conductor, dielectric, and shield largely ensures high signal transmission quality combined with low attenuation and low susceptibility to interference, provided the coaxial configuration and the associated characteristic impedance are maintained substantially constant over the entire length of the electrical cable. However, the cable ends, on which typically connector systems are mounted to communicatively connect the electrical cable to the components between which data is to be transmitted, are problematic in this context. During mounting of the connector system to the electrical cable, it is common that unwanted discontinuities are formed, for example by asymmetrical deformation of the electrical cable during attachment of the connector system to the electrical cable. Such discontinuities can affect the overall transmission quality of signals to be transmitted. For example, the discontinuities can cause frequency-dependent attenuations, also referred to as "notches." However, during mounting of the connector system to the electrical cable, it must be ensured at the same time that the connection between the connector system and the electric cable is sufficiently stable to ensure safe use of the electrical cable and the connector system. However, with the presently known connection methods, it is not possible to connect a connector system to an electrical cable in a reliable process without adversely affecting the transmission quality.

SUMMARY

In an embodiment, the present invention provides a method for producing a cable connection assembly including a cable connector and an electrical cable connected to the cable connector. The electrical cable includes at least an insulating layer and a cable jacket surrounding the insulating layer, the cable jacket being removed from at least one conductor end portion at least along a portion thereof. The method includes: positioning the cable connector on the at least one conductor end portion, so that a portion of the insulating layer is at least partially surrounded by the cable connector; disposing the at least one conductor end portion within a fastening tube, so that a first tube portion of the fastening tube surrounds the cable connector at least along a portion thereof, and a second tube portion of the fastening tube surrounds the cable jacket at least along a portion thereof pressing the fastening tube between a plurality of strip-shaped pressing surfaces which are disposed around a central axis at a constant distance from the central axis, the first tube portion being crimped to the cable connector and the second tube portion being crimped to the cable jacket. During the pressing step, the first tube portion is pressed to a first inner diameter and the second tube portion is pressed to a second inner diameter, the first inner diameter being less than the second inner diameter.

BRIEF DESCRIPTION OF THE DRAWINGS

Embodiments of the present invention will be described in even greater detail below based on the exemplary figures. The present invention is not limited to the exemplary embodiments. All features described and/or illustrated herein can be used alone or combined in different combinations in embodiments of the present invention. The features and advantages of various embodiments of the present invention will become apparent by reading the following detailed description with reference to the attached drawings which illustrate the following.

DETAILED DESCRIPTION

Figure 1:
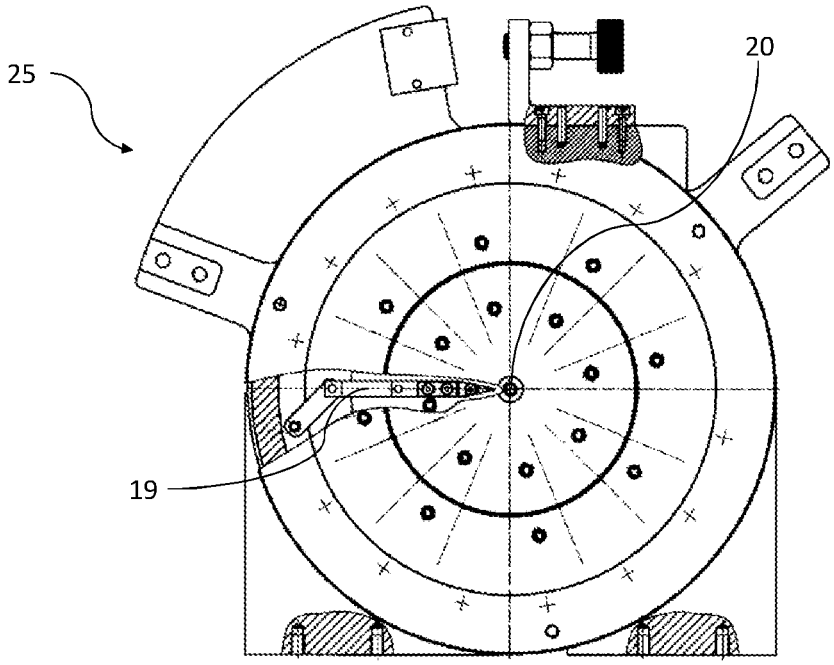
FIG. 1 is a view of a first embodiment of a device according to the invention for producing a cable connection assembly according to an embodiment of the invention.

In an embodiment, the present invention provides a method for producing a cable assembly, which method enables a stable connection to be created between a cable connector and an electrical cable, while maintaining high transmission quality for signals to be transmitted. Another embodiment of the invention provides a device for carrying out a method according to an embodiment of the invention.

A method according to an embodiment of the invention is directed to the production of a cable connection assembly including a cable connector and an electrical cable connected to the cable connector. A cable connector may be understood to be a component which is used for mechanically and electrically connecting the electrical cable to another component. The component may be, for example, an electronic component or another electrical cable. The component preferably includes a suitable mating connector element which is connectable to the cable connector. The cable connector is preferably configured as a sleeve element, the sleeve element preferably being of rotationally symmetrical configuration. The sleeve element may have regions of different diameter. Further, the cable connector may be formed from an electrically conductive material.

The electrical cable includes at least an insulating layer which preferably extends along a longitudinal direction of extent of the electrical cable, and a cable jacket which surrounds the insulating layer and preferably also extends along the longitudinal direction of extent of the electrical cable and which protects the electrical cable from external influences. Furthermore, the insulating layer may surround at least one electrically conductive inner conductor. In addition, an electrically conductive shield may be disposed between the insulating layer and the cable jacket, the electrically conductive shield surrounding the insulating layer. If the electrical cable has an inner conductor and a shield, it is preferred that the inner conductor, the insulating layer, the shield, and the cable jacket be arranged coaxially with each other.

The electrical cable has at least one conductor end portion from which the cable jacket is removed at least along a portion thereof, so that preferably at least the insulating layer is exposed. If a shield is disposed between the cable jacket and the insulating layer, the insulating layer may still be partially surrounded by the shield in the conductor end portion. If the electrical cable includes an inner conductor, the insulating layer may also be removed in the end portion, so that the inner conductor is exposed. The inner conductor may be single-core or multi-core.

The method according to an embodiment of the invention includes at least a step of positioning the cable connector on a conductor end portion, so that a portion of the insulating layer is at least partially surrounded by the cable connector. This can be achieved, for example, if the cable connector is configured as a sleeve element and at least partially slipped over the insulating layer. Therefore, it is preferred that the insulating layer have a smaller diameter than the cable connector. Preferably, the cable connector is positioned on the cable end portion in a region where the cable jacket is completely removed, so that overlapping of the cable jacket and the cable connector is avoided.

The method according to an embodiment of the invention further includes at least a step of disposing the conductor end portion within a fastening tube, so that a first tube portion of the fastening tube surrounds the cable connector at least along a portion thereof and a second tube portion of the fastening tube surrounds the cable jacket at least along a portion thereof. Preferably, the fastening tube has an initial inner diameter that is greater than the cable connector and greater than the electrical cable in the region of cable jacket. In this context, the term "initial inner diameter" may be understood to refer to the inner diameter of the fastening tube after its manufacture and prior to further processing thereof. Furthermore, the fastening tube is preferably seamless. The first tube portion is preferably defined by the portion of the fastening tube that surrounds the cable connector at least along a portion thereof when the cable end portion is disposed in fastening tube along with the cable connector. Analogously, the second tube portion is preferably defined by the portion of the fastening tube that surrounds the cable jacket at least along a portion thereof.

The method according to an embodiment of the invention further includes a step of pressing the fastening tube between a plurality of strip-shaped pressing surfaces which are disposed around a central axis, preferably along an imaginary circular path, at a constant distance from the central axis. The fastening tube is preferably positioned coaxially with the central axis between the pressing surfaces. In this context, the term "coaxial positioning" may be understood to mean that the fastening tube is positioned with its longitudinal axis on the central axis. It should be noted at this point that the central axis is an imaginary reference line to illustrate the arrangement and is not tangible.

The strip-shaped pressing surfaces preferably extend with their longest side parallel to the central axis. In addition, the pressing surfaces are preferably arranged with their longest sides parallel one another. During the step of pressing the fastening tube, the first tube portion is crimped to the cable connector and the second tube portion is crimped to the cable jacket. This is substantially accomplished by deforming the fastening tube in the pressing step. Thus, a frictional and/or interlocking connection is created between the fastening tube and both of the cable connector and the cable jacket. In this context, pressing is preferably effected by moving the pressing surfaces from a home position to a pressing position, thus causing them to press the fastening tube. Furthermore, it is preferred that the pressing surfaces synchronously, i.e., simultaneously, apply a force to the fastening tube. In this context, it is particularly preferred that the pressing surfaces each apply the same force to the fastening tube.

During the pressing step, the first tube portion is pressed to a first inner diameter and the second tube portion is pressed to a second inner diameter, the first inner diameter being less than the second inner diameter. In an embodiment, the first tube portion may be pressed to a first inner diameter that is less than or at least equal to an outer diameter of the cable connector, and the second tube portion may be pressed to a second inner diameter that is less than or at least equal to an outer diameter of the cable jacket.

In order to ensure that after the pressing step, the shape of the fastening tube is still substantially circular in shape, the pressing surfaces may be shaped in the form of a circular arc whose imaginary center is located on the central axis. In this connection, it is particularly preferred that the pressing surfaces in their totality form the shape of a complete circle whose center is particularly preferably located on the central axis.

The method according to an embodiment of the invention makes it possible to provide a method of manufacture of cable connection assemblies that connects a cable connector to an electrical cable in a stable manner while at the same time maintaining high transmission quality in the electrical cable and the cable connector. This is made possible, on the one hand, by the fastening tube being pressed by the plurality of strip-shaped pressing surfaces, which provide for uniform deformation of the fastening tube, thus allowing it to be crimped to the cable jacket and the cable connector in a uniformly distributed manner. This significantly reduces unwanted deformations in particular within the electrical cable. In addition, by pressing the fastening tube to the first inner diameter in the first tube portion and to the second inner diameter in the second tube portion, it is ensured that the electrical cable is not excessively squeezed in the pressing operation. At the same time, a coaxial configuration of the electrical cable can be substantially maintained, provided such configuration is desired.

During the pressing step, the fastening tube may be pressed along the entire length thereof. In this case, the length of the longest side of the strip-shaped pressing surfaces is preferably greater than the length of the fastening tube. Pressing the fastening tube along the entire length thereof makes it possible to define the deformation of the fastening tube more accurately and to reduce unwanted material accumulations, which may result, for example, from the flow of the material of the fastening tube. Furthermore, pressing of the fastening tube can be effected more uniformly.

Prior to the pressing step, the fastening tube may have a constant initial inner diameter. The first and second inner diameters cannot be produced before the pressing step. The use of a fastening tube having a constant initial diameter, on the one hand, facilitates the positioning of the fastening tube relative to the cable connector and the electrical conductor and, on the on the other hand, makes it possible to reduce the manufacturing cost of the fastening tube.

It has been found that the pressing of the fastening can be performed in a particularly advantageous manner when the fastening tube is pressed by at least ten, especially preferably at least sixteen pressing surfaces. The pressing surfaces may be disposed rotationally symmetrically around the central axis so that it is advantageous to always choose an even number of pressing surfaces. By using at least ten pressing surfaces, it can be ensured that after the pressing step, the fastening tube will still have a nearly circular shape, which significantly increases the stability of the crimped connection. This is because the forces acting on the fastening tube can be dissipated over the entire circumference of the cable connector and/or the circumference of the cable jacket.

During the pressing step, a gap in which the fastening tube remains unpressed may remain between at least two adjacent pressing surfaces. Preferably, a gap is disposed between all adjacent pressing surfaces. In this connection, it is particularly preferred that the gaps between adjacent pressing surfaces be all of equal size. Because the fastening tube remains impressed between the pressing surfaces, defined regions are created into which the material of the fastening tube can flow during the pressing step. In this way, it is possible to ensure that, despite the pressure-induced material flow, the fastening tube can be deformed in a defined manner in a reliable process.

It has found to be particularly advantageous if the pressing surfaces have a width that is no greater than ten times the width of the gap, preferably no greater than five times the width of the gap. In this context, the term "width of the gap" may be understood to refer to the distance by which two adjacent pressing surfaces are spaced apart when they are preferably in a pressing position. Accordingly, the width of the gap may be equal to the width of the unpressed region of the fastening tube. In this context, the term "width of a pressing surface" may be understood to refer to a short side disposed between two longest sides of the pressing surface.

If the electrical cable includes a shield, which is preferably disposed between the insulating layer and the cable jacket and preferably surrounds the insulating layer along the direction of longitudinal extent of the electrical cable, then, during the disposing step, the shield may be disposed between the fastening tube and a surface of the cable connector that faces the fastening tube. This is particularly advantageous when the cable connector is to be used as an outer conductor and an electrically conductive connection is required between the shield and cable connector. Since the shield is usually disposed directly on the insulating layer, it may be advantageous to perform a step of widening the shield prior to the positioning step in order to create a, preferably circumferential, space between the shield and the insulating layer at least along a portion thereof. This allows the cable connector to be positioned on the conductor end portion between the insulating layer and the shield in such a manner that it surrounds the insulating layer.

It has been found to be particularly advantageous if during the pressing step, the cable connector is pressed, at least in the first tube portion, to an inner diameter that is equal to an initial inner diameter of the shield. In this context, the term "initial inner diameter of the shield" may be understood to refer to the inner diameter of the shield prior to the pressing step and the widening step, provided a widening step is performed.

In addition to the inventive method, the invention relates to a device for producing a cable connection assembly in accordance with the inventive method.

The device according to an embodiment of the invention includes a plurality of tool segments which are disposed around a central axis, preferably along an imaginary circular path, at a constant distance from the central axis and which are, preferably synchronously, movable perpendicularly to the central axis between a home position and a pressing position, each tool segment having a strip-shaped pressing surface on a side facing the central axis. The pressing surfaces preferably extend with their longest sides parallel to each other and parallel to the central axis. Movement of the tool segments between the home position and pressing position may be effected, for example, by a pneumatic, mechanical, or electric drive. Each pressing surface includes at least a first pressing surface portion and at least a second pressing surface portion. The first pressing surface portion is spaced a lesser distance from the central axis than the second pressing surface portion. The first pressing surface portions (of preferably all tool segments) form a first pressing area. The second pressing surface portions (of preferably all tool segments) form a second pressing area.

The device according to an embodiment of the invention makes it possible to produce be a cable connection assembly in accordance with the inventive method. The first and second pressing areas allow the fastening tube to be pressed to the first inner diameter in the first tube portion and to the second inner diameter in the second tube portion. In this connection, it is preferred that at least a major portion of the first tube portion, more preferably the entire first pipe portion, be pressed in the first pressing area, and that at least a major portion of the second pipe portion, more preferably the entire second pipe portion, be pressed in the second pressing area.

The tool segments are preferably disposed equidistantly from one another, especially in the region of the pressing surfaces, so that a gap is formed between two tool segments. The distance between at least two adjacent tool segments in the home position may differ from a distance between at least two adjacent tool segments in the pressing position. However, it is preferred that the tool segments remain spaced apart even when in the pressing position.

A step may be formed between the first and second pressing surface portions. The step may extend perpendicularly to the central axis, so that an abrupt transition is provided between the first and second pressing surface portions. Alternatively, the step may be inclined, which allows for a smooth transition between the first and second pressing surface portions. Furthermore, it is advantageous if the step has a height no greater than twice the layer thickness of the cable jacket, more preferably no greater than the layer thickness of the cable jacket.

At least one pressing surface may have rounded edges extending parallel to the central axis. Preferably, the edges extend along the longest sides of the pressing surfaces. This is particularly advantageous when the tool segments are spaced apart from one another, so that an unpressed region remains in the fastening tube during the pressing step. Thus, due to the rounded edges, it is possible to avoid sharp transitions between pressed and unpressed regions in the fastening tube.

It has been found that a particularly uniform pressing of the fastening tube can be achieved by providing at least ten, more preferably at least sixteen tool segments. This makes it possible to ensure that the fastening tube will have a nearly circular shape even after the pressing step.

At least one tool segment may have a first sub-segment and a second segment, the first sub-segment providing the first pressing surface portion and the second sub-segment providing the second pressing surface portion. Through the use of sub-segments for creating the pressing surface portions, the shapes of the pressing surfaces can be produced and combined in a modular fashion.

In this context, it may be particularly advantageous if the first sub-segment and the second sub-segment are detachably connected to each other. This also allows the sub-segments to be used repeatedly in different configurations.

In order to promote and achieve a more defined flow of the material of the fastening tube during the pressing step, a chamfer may be provided between the first and second pressing surface portions. In the region of the chamfer or in the region of the step, the second pressing surface portion may additionally have a depression for forming a defined bead in the fastening tube during the pressing step. Moreover, a chamfer may also be provided at an end of the second pressing portion that faces away from the first pressing portion.

Furthermore, the first and/or second pressing surface portion(s) may have at least one elevation which extends from the pressing surface portion where it is located toward the central axis. The elevation may be shaped such that during the pressing step, a depression or, particularly preferably, an undercut is formed in the fastening tube. Such a depression makes it possible, for example, to improve the mechanical stability of the crimped connection between the fastening tube and the cable connector and/or the cable jacket. The elevation may be point-shaped or linear or areal in shape.

Embodiments of the invention have been described with reference to a method and a device. Unless otherwise specified, the explanations concerning the method apply analogously to the device, and, of course, vice versa. The embodiments of the device may also find expression in the method. In addition, further advantages and features of the present invention will be apparent from the following description of preferred embodiments. The features described therein and hereinabove may be implemented alone or in combination, unless the features contradict each other.

FIG. 1 shows a first embodiment of an inventive device 25 for carrying out a method according to the invention. Device 25 includes sixteen tool segments 19 disposed around a central axis 20. More specifically, tool segments 19 are disposed circularly around central axis 20 at a constant distance from central axis 20. Tool segments 19 are movable perpendicularly to central axis 20 between a home position and a pressing position by means of a mechanical drive. An actuating trip is disposed on central axis 20 at a rear surface of device 25. When the actuating trip is operated, tool segments 19 move from the home position to the pressing position. Since the actuating trip is disposed on central axis 20, it can be triggered by an electrical cable to be pressed, namely by inserting the electrical cable along central axis 20 into device 25 until the electrical cable operates the actuating trip. Thus, the actuating trip may additionally serve to properly position the electrical cable between tool segments 19. Upon completion of the pressing operation, tool segments 19 move back to the home position.

Figure 2:
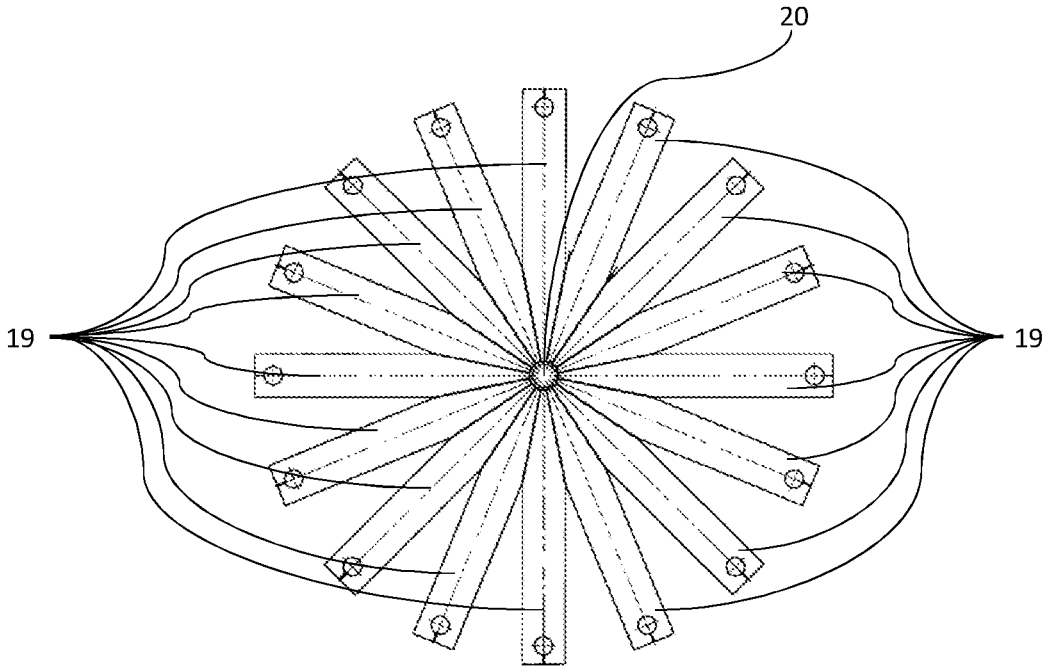
FIG. 2 is a schematic view of an arrangement of tool segments in accordance with the first embodiment.

FIG. 2 shows, in schematic form, the tool segments 19 according to the first exemplary embodiment. Tool segments 19 are arranged rotationally symmetrically. The axis of symmetry coincides with central axis 20. Each tool segment 19 is associated with a diametrically opposite tool segment 19. Tool segments 19 are of uniform construction and can therefore be regarded as identical parts. Tool segments 19 taper in shape toward central axis 20 in order, on the one hand, to enable the drive to be mounted in a stable manner at an end facing away from central axis 20 and, at the same time, to allow for a maximally dense arrangement in the region of central axis 20.

Figure 3:
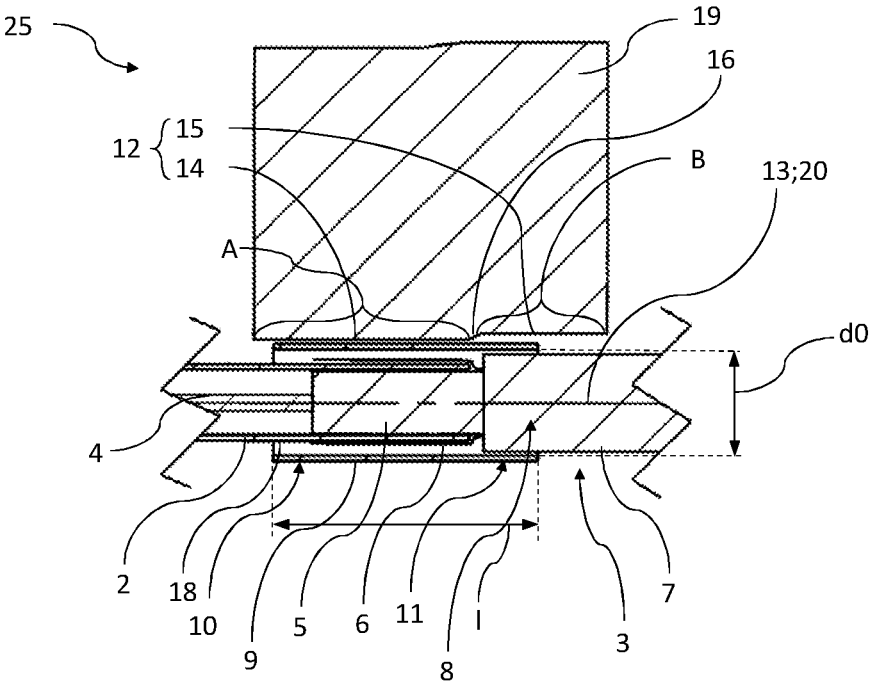
FIG. 3 is a sectional view of a second embodiment of a device according to the invention, shown in a home position.

FIG. 3 shows, in sectional view, a second embodiment of an inventive device 25 in a home position in the region of central axis 20, the sectional plane extending along central axis 20. In the present exemplary embodiment, sixteen tool segments 19 of uniform construction are disposed around central axis 20. However, for the sake of clarity, only one tool segment 19 is shown in FIG. 3. Tool segment 19 is in the home position. A conductor end portion 8 of an electrical cable 3 is disposed on central axis 20. In the present exemplary embodiment, electrical cable 3 is a coaxial cable including an inner conductor 4 made of copper, an insulating layer 5, a shield 6 made of braided copper wire, and a cable jacket 7.

In the region of conductor end portion 8, cable jacket 7 is removed, so that shield 6 is exposed. Furthermore, insulating layer 5 and shield 6 are also removed along part of conductor end portion 8, so that inner conductor 4 is exposed. In a previous step, the exposed inner conductor 4 was crimped to a crimp barrel. A cable connector 2 is positioned on electrical cable 3 in conductor end portion 8. In the present exemplary embodiment, cable connector 2 is formed by a sleeve element made of bronze. Cable connector 2 is disposed on conductor end portion 8 between an insulating layer 5 and shield 6, with cable connector 2 partially surrounding insulating layer 5. In other words, insulating layer 5 is partially disposed within the cable connector 2. To this end, cable connector 2 has a diameter that is greater than a diameter of insulating layer 5. To allow cable connector 2 to be disposed between insulating layer 5 and shield 6, shield 6 was widened in a previous step, so that there is a space between shield 6 and insulating layer 5. Subsequent to this, cable connector 2 was slipped onto insulating layer 5. Shield 6 is disposed on a surface 18 of cable connector 2 that faces away from insulating layer 5, so that shield 6 is electrically conductively connected to cable connector 2.

Conductor end portion 8 and cable connector 2 are disposed within a fastening tube 9. In the present exemplary embodiment, fastening tube 9 is also made of bronze. Fastening tube 9 is disposed relative to cable connector 2 and electrical cable 3 in such a manner that a first tube portion 10 of fastening tube 9 surrounds shield 6 and second tube portion 11 surrounds cable jacket 7. Fastening tube 9 is disposed with a centerline 13 on central axis 20. Furthermore, the fastening tube is seamless and has a consistent initial diameter d0 along its length 1.

In the present exemplary embodiment, tool segment 19 is made of steel and has a pressing surface 12 which is divided into a first pressing surface portion 14 and a second pressing surface portion 15. The two pressing surface portions 14, 15 are divided by a step 16 which, in the present exemplary embodiment, is disposed at an angle of 50 degrees with respect to central axis 20. Step 16 is created by a difference in relative height between first pressing surface portion 14 and second pressing surface portion 15. In the present exemplary embodiment, the height of the step is 0.1 mm. The first pressing surface portions 14 of the sixteen tool segments 19 form a first pressing area A, and the second pressing surface portions 15 form a second pressing area B.

Figure 4:
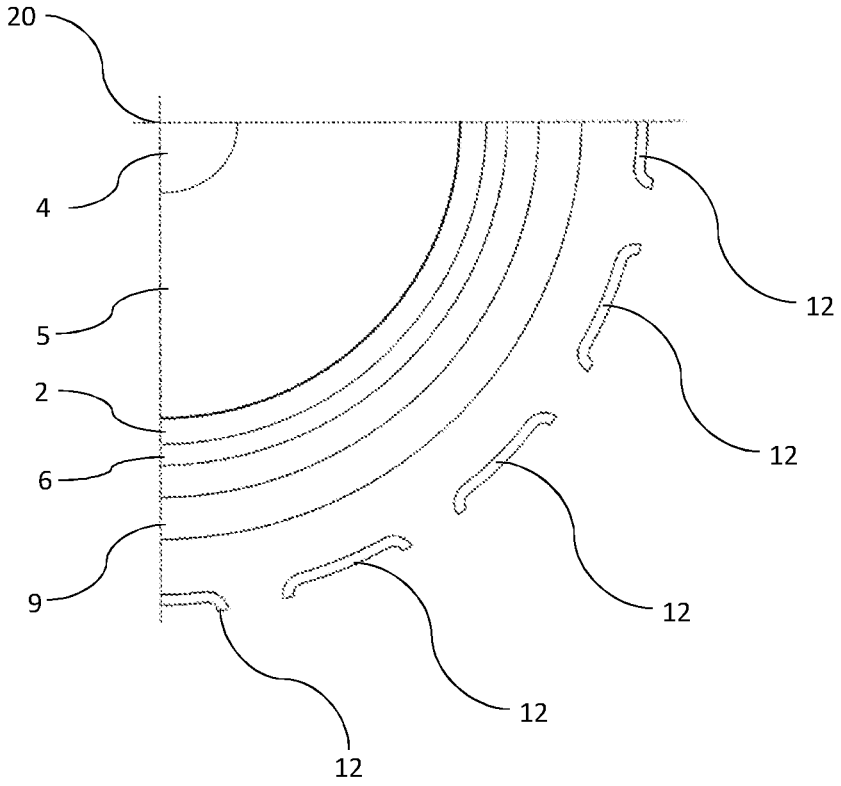
FIG. 4 is an enlarged, alternative sectional view of the device according to the second embodiment, shown in a home position.

FIG. 4 shows, in an enlarged sectional view, the second exemplary embodiment in first pressing area A. For the sake of clarity, a circular sector of the electrical cable and the inventive device 25 is shown with central axis 20 as the center. The sectional plane is perpendicular to central axis 20. The pressing surfaces 12 of the individual tool segments are disposed equidistantly from each other around central axis 20. Since pressing surfaces 12 are in the home position, pressing surfaces 12 are also spaced apart from fastening tube 9.

Figure 5:
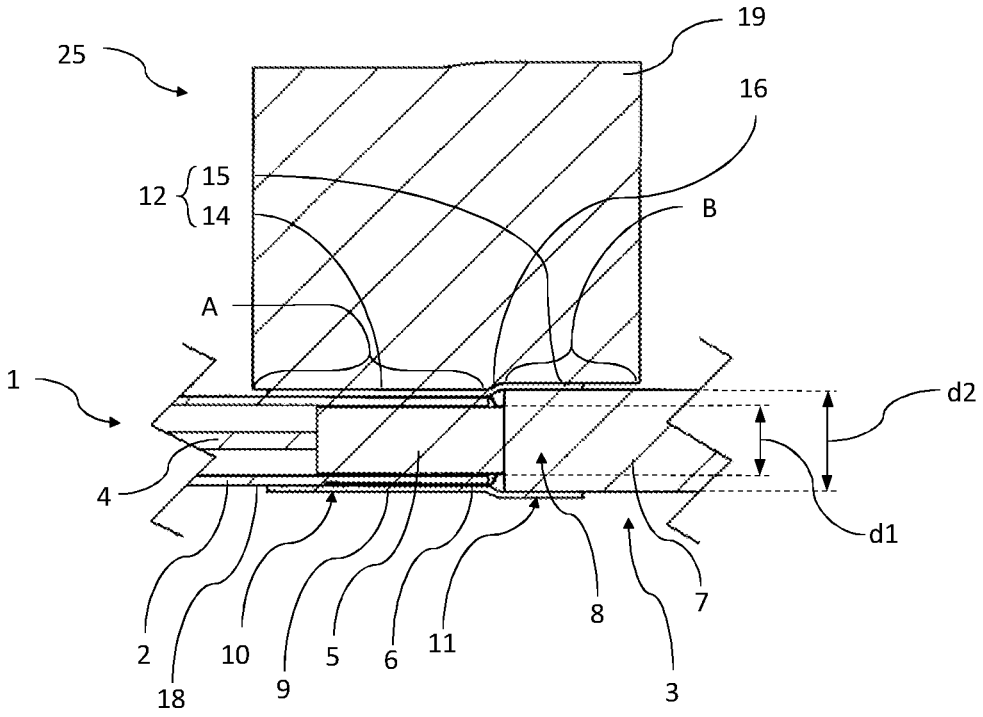
FIG. 5 is a sectional view of the second embodiment of the device, shown in a pressing position.

FIG. 5 shows the second exemplary embodiment of inventive device 25 in a pressing position. Fastening tube 9 is pressed by moving the tool segments 19 from the home position to the pressing position. In this process, first pressing area A presses first tube portion 10 to a first inner diameter d1. Second pressing area B presses second tube portion 11 to a second inner diameter d2. First inner diameter d1 is less than second inner diameter d2. The transition between first and second inner diameters d1, d2 of fastening tube 9 is provided by the step 16 between pressing areas A, B. The chamfered shape of step 16 ensures that no sharp-edged regions are formed on fastening tube 9. In addition, in first tube portion 10, shield 6 is pressed between fastening tube 9 and cable connector 2, so that a frictional, conductive connection is created between cable connector 2 and shield 6. Moreover, in first tube portion 10, fastening tube 9 is crimped to cable connector 2. In contrast, second tube portion 11 is crimped to cable jacket 7. In the present exemplary embodiment, fastening tube 9 is pressed along its entire length 1. Through the pressing of fastening tube 9 and the associated crimping to cable connector 2 and cable jacket 7, the cable connection assembly 1 according to the invention is created.

Figure 6:
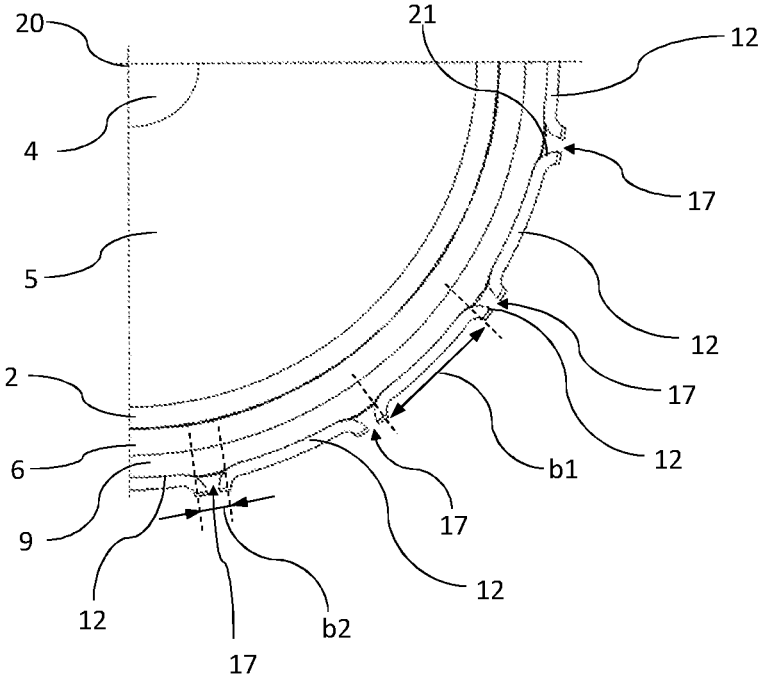
FIG. 6 is an enlarged, alternative sectional view of the device according to the second embodiment, shown in a pressing position.

FIG. 6 shows the circular sector of the second embodiment in first pressing area A with the tool segments 19 in a pressing position. When in the pressing position, all pressing surfaces 12 act simultaneously with the same force on fastening tube 9, thus deforming fastening tube 9 by exerting pressure thereon. Even in the pressing position, pressing surfaces 12 are equidistantly spaced apart, so that a gap 17 remains between each two adjacent pressing surfaces 12 in the pressing position. In the region of gap 17, fastening tube 9 is not pressed, so that unpressed regions remain between pressing surfaces 12 even upon completion of the pressing operation. In the present exemplary embodiment, in order to ensure that even after the pressing operation, fastening tube 9 is still substantially circular in shape, the ratio of width b1 of pressing surfaces 12 to width b2 of gaps 17 is selected to be 1:6. Accordingly, a width B1 of the pressing surfaces is equal to six times the width b2 of gaps 17. In order to promote the flow of the material of fastening tube 9 during the pressing operation, the pressing surfaces have rounded edges 21 along the sides that are parallel to the central axis.

Figure 7:
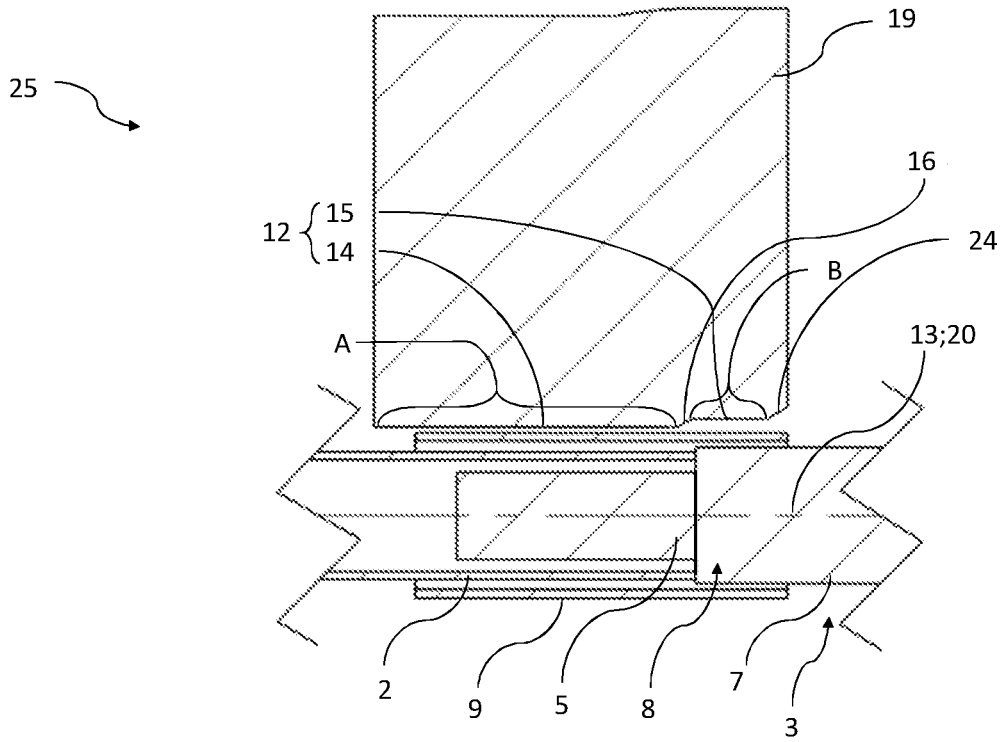
FIG. 7 is a sectional view of a third embodiment of a device according to the invention, shown in a home position.

FIG. 7 shows a third embodiment of the inventive device 25 in a sectional view where only one tool segment 19 is shown in the home position for the sake of clarity. Tool segment 19 has a chamfer 24 at an end of second pressing area B that faces away from first pressing area A. Chamfer 24 promotes the flow of the material of fastening tube 9 during the pressing operation.

Figure 8:
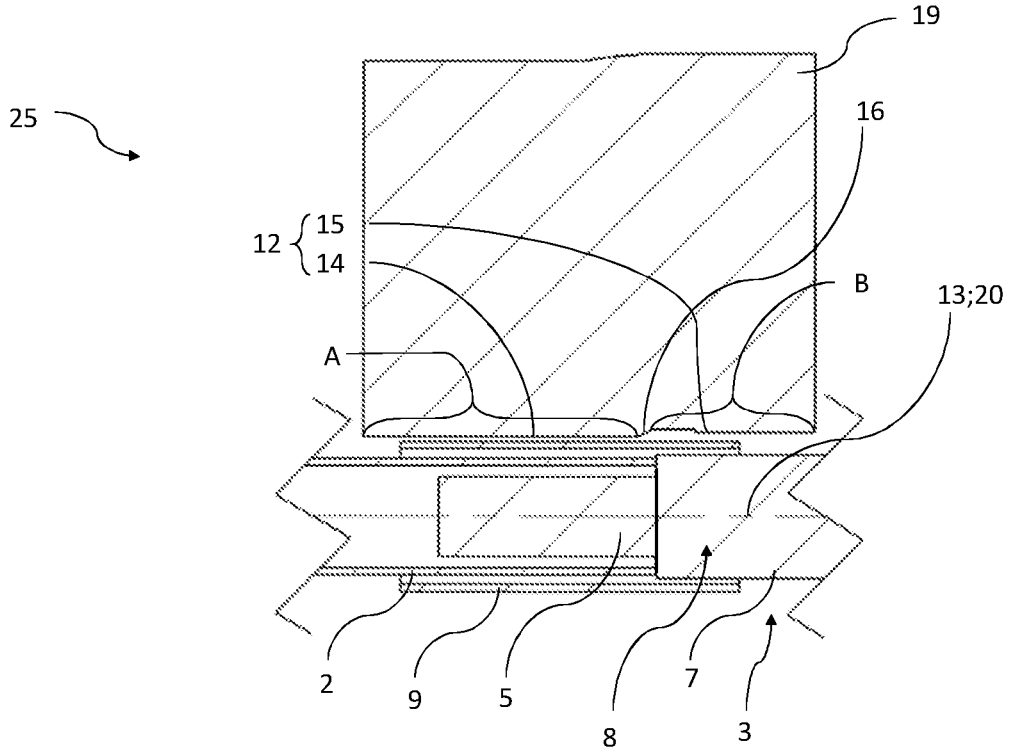
FIG. 8 is a sectional view of a fourth embodiment of a device according to the invention, shown in a home position.

FIG. 8 shows, in sectional view, a fourth embodiment of inventive device 25. Tool segment 19 is in the home position. Tool segment 19 has a depression between step 16 and second pressing surface portion 15. During the pressing operation, the depression can provide a space into which the flowing material of fastening tube 9 can enter and form a bead therein.

Figure 9:
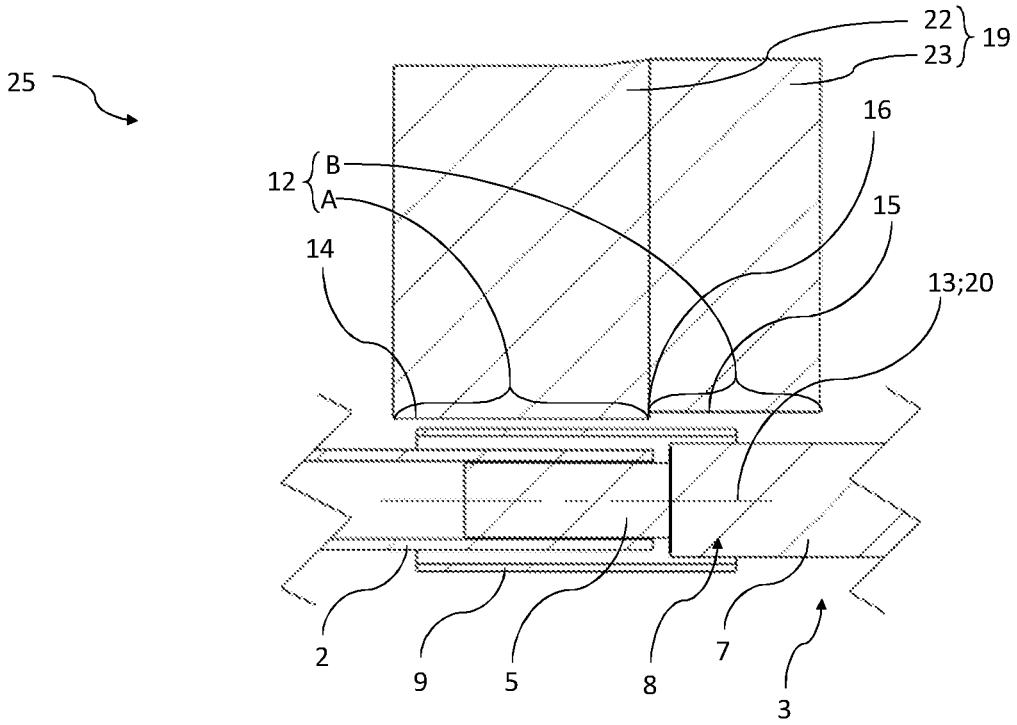
FIG. 9 is a sectional view of a fifth embodiment of a device according to the invention, shown in a home position.

FIG. 9 shows, in sectional view, a fifth embodiment of an inventive device 25. Tool segment 19 has a first sub-segment 22 and a second sub-segment 23. Sub-segments 22, 23 are screwed together. First sub-segment 22 provides the first pressing surface portion 14. Second sub-segment 23 is provides the second pressing surface portion 15.

The explanations provided with regard to the figures are merely for the sake of illustration and are not to be construed as limiting.

While embodiments of the invention have been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE CHARACTERS

1 cable connection assembly
2 cable connector
3 electrical cable
4 inner conductor
5 insulating layer
6 shield
7 cable jacket
8 conductor end portion
9 fastening tube
10 first tube portion
11 second tube portion
12 pressing surface
13 centerline of the fastening tube
14 first pressing surface portion
15 second pressing surface portion

16 step
17 gap
18 surface of the cable connector
19 tool segment
20 central axis
21 edges
22 first sub-segment
23 second sub-segment
24 chamfer
25 device
d0 initial inner diameter
d1 first inner diameter (first tube portion)
d2 second inner diameter (second tube portion)
L length of the fastening tube
b1 width of pressing surface
b2 width of gap
A first pressing area
B second pressing area

What is claimed is:

1. A method for producing a cable connection assembly including a cable connector and an electrical cable connected to the cable connector, the electrical cable including at least an insulating layer and a cable jacket surrounding the insulating layer, the cable jacket being removed from at least one conductor end portion at least along a portion thereof, the method comprising:

positioning the cable connector on the at least one conductor end portion, so that a portion of the insulating layer is at least partially surrounded by the cable connector;

disposing the at least one conductor end portion within a fastening tube, so that a first tube portion of the fastening tube surrounds the cable connector at least along a portion thereof, and a second tube portion of the fastening tube surrounds the cable jacket at least along a portion thereof;

pressing the fastening tube between a plurality of strip-shaped pressing surfaces which are disposed around a central axis at a constant distance from the central axis, the first tube portion being crimped to the cable connector and the second tube portion being crimped to the cable jacket;

wherein, during the pressing step, the first tube portion is pressed to a first inner diameter and the second tube portion is pressed to a second inner diameter, the first inner diameter being less than the second inner diameter.

2. The method as recited in claim 1, wherein, during the pressing step, the fastening tube is pressed along the entire length of the fastening tube.

3. The method as recited in claim 1, wherein, prior to the pressing step, the fastening tube has a constant initial inner diameter.

4. The method as recited in claim 1, wherein the fastening tube is pressed by at least ten pressing surfaces synchronously.

5. The method as recited in claim 1, wherein the fastening tube is pressed by at least sixteen pressing surfaces synchronously.

6. The method as recited in claim 1, wherein, during the pressing step, a gap in which the fastening tube remains unpressed remains between at least two adjacent ones of the pressing surfaces.

7. The method as recited in claim 6, wherein the pressing surfaces have a width that is no greater than ten times a width of the gap.

8. The method as recited in claim 6, wherein the pressing surfaces have a width that is no greater than five times a width of the gap.

9. The method as recited in claim 1, wherein the electrical cable includes a shield, and wherein, during the disposing step, the shield is disposed between the fastening tube and a surface of the cable connector that faces the fastening tube.

10. The method as recited in claim 9, wherein, during the pressing step, the cable connector is pressed, at least in the first tube portion, to an inner diameter that is equal to an initial inner diameter of the shield.

11. A device for producing a cable connection assembly in accordance with the method according to claim 1, the device comprising:

a plurality of tool segments which are disposed around a central axis at a constant distance from the central axis and which are synchronously movable orthogonally to the central axis between a home position and a pressing position, each of the tool segments having a strip-shaped pressing surface on a side facing the central axis, each of the pressing surfaces including at least a first and a second pressing surface portion, the first pressing surface portion being spaced by a lesser distance from the central axis than the second pressing surface portion, wherein the first pressing surface portions form a first pressing area and the second pressing surface portions form a second pressing area.

12. The device as recited in claim 11, wherein a step is formed between the first and second pressing surface portions.

13. The device as recited in claim 12, wherein a height of the step is no greater than a layer thickness of the cable jacket of the electrical cable.

14. The device as recited in claim 12, wherein at least one of the tool segments has at least one chamfer in a region of the pressing surface.

15. The device as recited in claim 12, wherein, in the first and/or in the second pressing surface portion, there is disposed at least one elevation which extends from the pressing surface portion toward the central axis.

16. The device as recited in claim 11, wherein at least one of the pressing surfaces has rounded edges extending parallel to the central axis.

17. The device as recited in claim 11, wherein at least ten of the tool segments are provided.

18. The device as recited in claim 11, wherein the tool segments are disposed symmetrically around the central axis.

19. The device as recited in claim 11, wherein at least one of the tool segments has a first sub-segment and a second sub-segment, the first sub-segment providing the first pressing surface portion and the second sub-segment providing the second pressing surface portion.

20. The device as recited in claim 19, wherein the first sub-segment and the second sub-segment are detachably connected to each other.

* * * * *